US011091913B2

(12) United States Patent
Sorkin

(10) Patent No.: US 11,091,913 B2
(45) **Date of Patent: *Aug. 17, 2021**

(54) INTERMEDIATE ANCHOR FOR A POST-TENSIONING TENDON

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,017

(22) Filed: May 16, 2020

(65) Prior Publication Data

US 2020/0378123 A1 Dec. 3, 2020

Related U.S. Application Data

(60) Provisional application No. 62/853,547, filed on May 28, 2019.

(51) Int. Cl.
*E04C 5/12* (2006.01)

(52) U.S. Cl.
CPC ..... *E04C 5/125* (2013.01)

(58) Field of Classification Search
CPC . E04C 5/125; E04C 5/122; E04C 5/10; E04G 21/185; E04G 23/02; E04G 21/12
See application file for complete search history.

(56) References Cited

U.S. PATENT DOCUMENTS 4,363,122 A * 12/1982 Black ..... H04J 3/172 370/435
4,363,462 A * 12/1982 Wlodkowski ..... E04C 5/12 24/115 M
4,410,162 A * 10/1983 Wlodkowski ..... E04C 5/12 249/215
5,770,286 A 6/1998 Sorkin
6,098,356 A 8/2000 Sorkin
6,381,912 B1 5/2002 Sorkin
6,631,596 B1 10/2003 Sorkin
6,761,002 B1 7/2004 Sorkin
(Continued)

FOREIGN PATENT DOCUMENTS

WO 2016126687 A1 8/2016

OTHER PUBLICATIONS

Extended European Search Report issued in EP App. No. 20175370.4, dated Nov. 2 ,2020 (7 pages).

*Primary Examiner* — Patrick J Maestri
(74) *Attorney, Agent, or Firm* — Locklar PLLC

(57) ABSTRACT

An anchor assembly for use on a tension member in a post-tensioning concrete application, the anchor assembly may comprise an encapsulated anchor body, the encapsulation defining front and rear encapsulation extensions, a rear nut engaging the rear encapsulation extension, a cap engaging the front encapsulation extension and having a cap extension, a front nut engaging the cap extension, wherein placement of a tension member in the anchor assembly results in definition of front and rear annular spaces, and front and rear seal positioned in the front and rear annular spaces, respectively. The seals may be split seals. A method includes positioning a tension member in the bore, decoupling the cap from the front encapsulation extension, positioning at least one wedge in the frustoconical inner chamber, recoupling the cap, decoupling the front and rear nuts; positioning a seal in each annular space, and recoupling the front and rear nuts.

16 Claims, 1 Drawing Sheet

(56) References Cited

U.S. PATENT DOCUMENTS

| | | | | |
|---|---|---|---|---|
| 6,817,148 | B1 | 11/2004 | Sorkin | |
| 7,275,347 | B2 | 10/2007 | Hayes | |
| 7,963,078 | B1 * | 6/2011 | Sorkin | E04C 5/122 52/223.13 |
| 9,896,845 | B2 * | 2/2018 | Sorkin | E04C 5/125 |
| 10,711,454 | B2 * | 7/2020 | Sorkin | E04C 5/122 |
| 2002/0083659 | A1 | 7/2002 | Sorkin | |

* cited by examiner

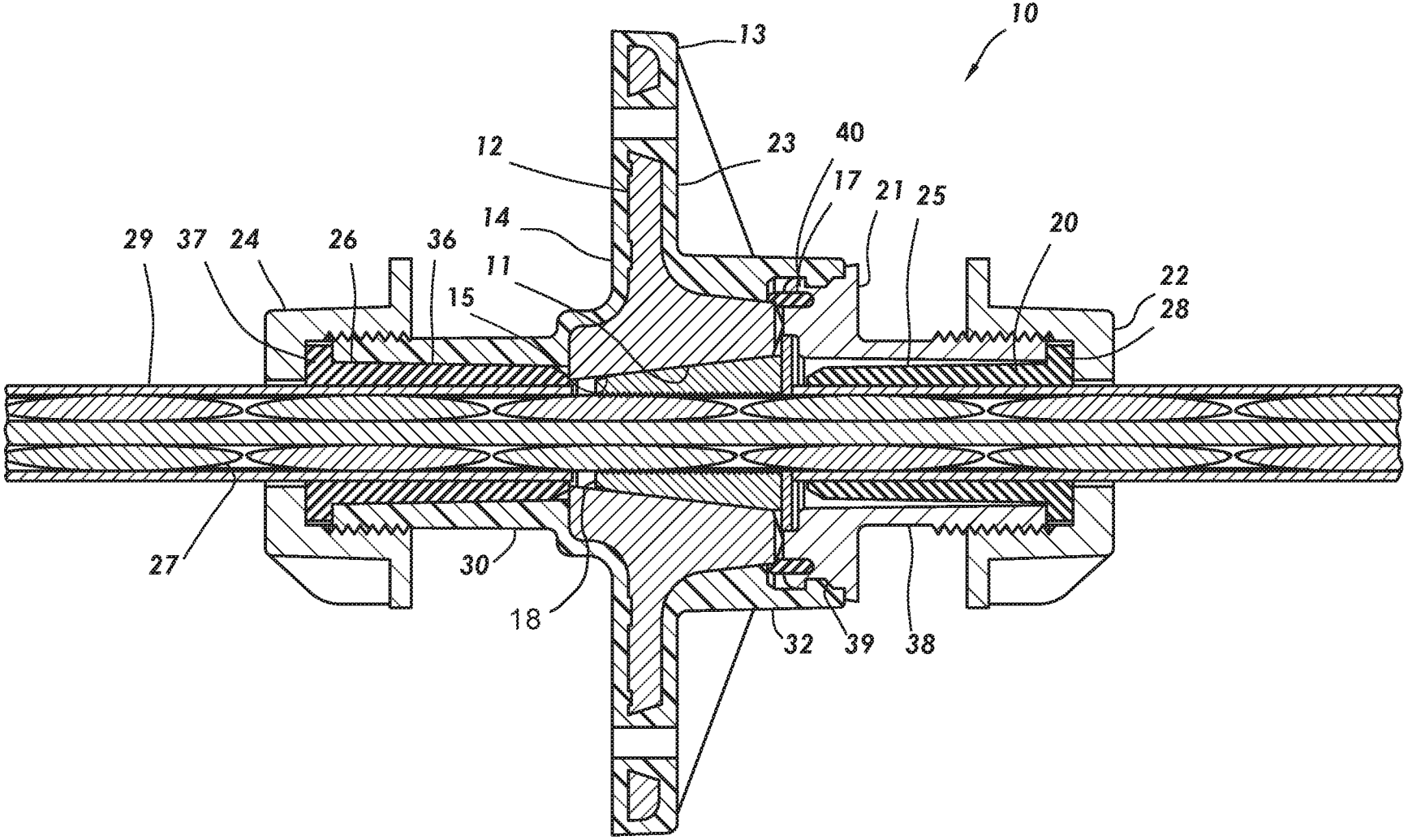
10
22
28
20
25
21
40
17
23
13
12
14
11
15
36
26
24
37
29
27
30
18
32
39
38

INTERMEDIATE ANCHOR FOR A POST-TENSIONING TENDON

CROSS-REFERENCE TO RELATED U.S. APPLICATIONS

This application is a non-provisional application which claims priority from U.S. provisional application No. 62/853,547, filed May 28, 2019, which is incorporated by reference herein in its entirety.

TECHNICAL FIELD/FIELD OF THE DISCLOSURE

The present disclosure relates generally to anchors for use in post-tensioning concrete, and specifically to intermediate anchors for post-tensioning tendons.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, bridges, pavement, tanks, reservoirs, silos, foundations, sports courts, and other structures.

The concrete may be poured into a concrete form. The concrete form may be a form or mold to give shape to the concrete as the concrete sets or hardens thus forming a concrete member.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a post-tensioning tendon embedded in the concrete is tensioned after the concrete has attained a specified strength. A post-tensioning tendon may include for example and without limitation, anchorages, the tension member, and sheathes or ducts.

A post-tensioning tendon generally includes an anchorage at each end. The tension member is fixedly coupled to a fixed anchor positioned at one end of the post-tensioning tendon, sometimes referred to as the "fixed-end" or "dead end" anchor, and is stressed at the other anchor, sometimes referred to as the "stressing-end" or "live end" anchor.

The tension member is stressed by pulling the tension member through the stressing anchor; when the pulling force is released, the anchors grip the tension member and retain the tension member in tension. In some instances, the anchors grip the tension member using wedges, so that the gripping force increases when the tension on the tension member increases.

In some instances, it may be desirable to pour a long concrete slab in sections. In such instances, the sections are poured sequentially, with each pour section curing and being post-tensioned before the next, adjacent section is poured. In such instances, the anchors between adjacent slabs are known as "intermediate anchors." Because intermediate anchors typically entail an interruption of the sheathing that otherwise protects the tension member from corrosion, and because intermediate anchors are ultimately fully embedded in concrete, intermediate anchors need to be able to inhibit the ingress of liquid that may cause corrosion.

SUMMARY

An anchor assembly for use in post-tensioning concrete may include an anchor body having an anchor body bore therethrough and an encapsulation, the encapsulation defining a front encapsulation extension and a rear encapsulation extension. Each of the front encapsulation extension and the rear encapsulation extension has a bore aligned with the anchor body bore, a rear nut engaging the rear encapsulation extension such that placement of a tension member in the anchor assembly enables the rear nut, the rear encapsulation extension, and the anchor body to define a rear annular space therewith. The anchor assembly also includes a cap engaging the front encapsulation extension, the cap having a bore therethrough, and a cap extension, a front nut engaging the cap extension such that placement of a tension member in the anchor assembly enables the front nut, the cap extension, and the anchor body to define a front annular space therebetween, a rear seal positioned in the rear annular space and configured such that engagement of the rear nut with the rear encapsulation extension deforms the rear seal if a tension member is present in the anchor assembly, and a front seal positioned in the front annular space and configured such that engagement of the front nut with the cap extension deforms the front seal if a tension member is present in the anchor assembly.

The rear seal and the front seal may each be a split seal. At least one of the front nut and the rear nut may be a self-tapping nut. The cap may include an annular groove and a cap seal disposed in the annular groove. At least one of the rear seal and the front seal may include a head and a tubular body extending therefrom. The rear seal and the front seal may each include a longitudinal split.

A method for anchoring and sealing a tension member in a post-tensioning concrete application may include the steps of: a) providing an anchor assembly including an anchor body having an anchor body bore therethrough, a frustoconical inner chamber, and an encapsulation, the encapsulation defining a front encapsulation extension and a rear encapsulation extension, each of the front encapsulation extension and the rear encapsulation extension having a bore aligned with the anchor body bore; a rear nut coupled to the rear encapsulation extension, wherein placement of a tension member in the anchor assembly results in the rear nut, the rear encapsulation extension, and the anchor body defining a rear annular space therewith; a cap coupled to the front encapsulation extension, the cap having a bore therethrough, and a cap extension; and a front nut coupled to the cap extension, wherein placement of a tension member in the anchor assembly results in the front nut, the cap extension, and the anchor body defining a front annular space therewith; b) positioning the tension member in the anchor body bore; c) decoupling the cap from the front encapsulation extension; d) positioning at least one wedge in the frustoconical inner chamber; e) tensioning tension member; f) recoupling the cap to the front encapsulation extension; g) decoupling the rear nut from the rear encapsulation extension; h) positioning a deformable rear seal in the rear annular space; i) recoupling the rear nut to the rear encapsulation extension; j) decoupling the front nut from the cap extension; k) positioning a front seal in the front annular space; and l) recoupling the front nut to the cap extension.

Completion of steps f) through l) may sealingly enclose a portion of the tension member between the rear seal and the front seal. Engagement of the rear nut with the rear encapsulation extension may deform the rear seal and engagement of the front nut with the cap extension may deform the front seal. The rear seal and the front seal may each be a split seal. Each of the rear seal and the front seal may include a longitudinal split. At least one of the rear seal and the front seal may include a head and a tubular body extending therefrom. At least one of the front nut and the rear nut may be a self-tapping nut. The cap may include an annular groove and a cap seal may be disposed in the annular groove. Engagement of the cap with the front encapsulation may deform the cap seal.

BRIEF DESCRIPTION OF THE DRAWING

The FIGURE shows a cross-sectional view of an anchor consistent with at least one embodiment of the present disclosure.

DETAILED DESCRIPTION

Referring to the FIGURE, intermediate anchor assembly 10 in accordance with some embodiments may include anchor body 12, encapsulation 13, cap 21, front nut 22, and rear nut 24. Anchor body 12 may be encapsulated in encapsulation 13. Anchor body 12 may have anchor body bore 11 extending therethrough and adapted to receive tension member 27. Tension member 27 may include sheathing 29. A portion of sheathing 29 may be removed from the portion of the tension member 27 that passes through anchor body bore 11 of anchor body 12. Anchor body 12 may have a frustoconical inner surface defining a frustoconical inner chamber 15 in which a plurality of wedges 18 may seat to tension the tension member 27 extending through anchor body bore 11.

Encapsulation 13 may have rear surface 14 and front surface 23.

Rear surface 14 may include rear encapsulation extension 30 extending outwardly therefrom. Rear encapsulation extension 30 may include an inner bore coaxially aligned with anchor body bore 11. Rear encapsulation extension 30 may be tubular. Rear encapsulation extension 30 may or may not be tapered and may or may not include external threads or bayonet tabs or a groove or ridge for securing a snap-fit. The inside diameter of rear encapsulation extension 30 may be greater than the outside diameter of tension member 27 or sheathing 29 so as to define an annular space therewith.

Front surface 23 may include a front encapsulation extension 32 extending outwardly therefrom, Front encapsulation extension 32 may include an inner bore coaxially aligned with anchor body bore 11. Front encapsulation extension 32 may be annular. Front encapsulation extension 32 may or may not include internal threads or bayonet tabs or a groove or ridge for securing a snap-fit.

Rear seal 26 may sealingly engage rear encapsulation extension 30. Rear seal 26 may be a split seal having a longitudinal split that enables rear seal 26 to be applied to a tension member from the side, i.e. without requiring access to the tension member end. Rear seal 26 may be made of a soft elastomer, rubber, silicone, or other suitably deformable sealing material. Rear seal 26 may be sized to fit in the annular space between rear encapsulation extension 30 and tension member 27. Rear nut 24 may be provided to retain rear seal 26. Rear nut 24 may concentrically engage rear encapsulation extension 30 at the external threads or bayonet tabs or a groove or ridge thereon, if present, and may include corresponding internal threads, bayonet tabs or a ridge or groove. In some embodiments, rear encapsulation extension 30 may be provided without an engagement feature and rear nut 24 may be a self-tapping nut that creates threads when it is threaded onto rear encapsulation extension 30.

In some embodiments, rear seal 26 may have body 36 and head 37. The outside diameter of body 36 may be the same as or smaller than the inside diameter of rear encapsulation extension 30 so that rear seal 26 may be applied to the side of tension member 27 and then slid along the tension member and into the annular space between rear encapsulation extension 30 and tension member 27. Rear seal 26 may be sized to have a volume greater than the volume of the annular space between rear encapsulation extension 30 and tension member 27 so that when rear nut 24 is fully engaged on rear encapsulation extension 30 rear seal 26 is compressed into a volume that is smaller than it would otherwise occupy. Head 37 of rear seal 26 may be compressed between the rear nut 24 and the end of rear encapsulation extension 30. Rear seal 26 may be formed of a deformable material that conforms to the shape of the annular space so that when rear nut 24 is fully engaged on rear encapsulation extension 30 there are no unfilled voids between anchor body 12 and rear nut 24.

Cap 21 may releasably engage front encapsulation extension 32 by, for example and without limitation, friction fit, threads, or bayonet connection. Cap 21 may include an engagement interface 39, a cap extension 38, and an inner bore that aligns with anchor body bore 11. Engagement interface 39 may concentrically engage front encapsulation extension 32 at the internal threads or bayonet tabs or a groove or ridge, if present, and may include corresponding external threads, bayonet tabs or a ridge or groove. Cap extension 38 may be tubular in shape. Cap extension 38 may be tapered and may include external threads or bayonet tabs or a groove or ridge for securing a snap-fit. The inside diameter of cap extension 38 may be greater than the outside diameter of tension member 27 so as to define an annular space therewith.

Cap seal 17 may be disposed in an annular groove 40 formed in cap 21 such that cap seal 17 sealingly engages at least one of anchor body 12 or encapsulation 13 when cap 21 is fully engaged on front encapsulation extension 32. Cap seal 17 may be annular.

Front seal 20 may sealingly engage front encapsulation extension 32. Front seal 20 may be a split seal having a longitudinal split that enables front seal 20 to be applied to tension member 27 from the side, i.e. without requiring access to the tension member end. Front seal 20 may be made of a soft elastomer, rubber, silicone, or other suitably deformable sealing material. Front seal 20 may be sized to fit in the annular space between cap extension 38 and tension member 27. Front nut 22 may be provided to retain front seal 20. Front nut 22 may engage cap extension 38 at the external threads or bayonet tabs or a groove or ridge thereon, if present, and may include corresponding internal threads, bayonet tabs or a ridge or groove. In some embodiments, cap extension 38 may be provided without an engagement feature and front nut 22 may be a self-tapping nut that creates threads when it is threaded onto cap extension 38.

Front seal 20 may have body 25 and head 28. The outside diameter of body 25 may be the same as or smaller than the inside diameter of cap extension 38 so that front seal 20 may be applied to the side of tension member 27 and then slid along tension member 27 and into the annular space between cap extension 38 and tension member 27. Front seal 20 may be sized to have a volume greater than the volume of the annular space between cap extension 38 and tension member 27 so that when front nut 22 is fully engaged on cap extension 38 front seal 20 is compressed into a volume that is smaller than it would otherwise occupy. Head 28 of front seal 20 is compressed between front nut 22 and the end of cap extension 38. Front seal 20 may be formed of a deformable material that conforms to the shape of the annular space so that when front nut 22 is fully engaged on cap extension 38 there are no unfilled voids between anchor body 12, cap 21, and rear nut 24.

The components of the intermediate anchor assembly 10 may be pre-assembled prior to delivery to the pour site or may be assembled at the pour site.

In operation as part of a sequential pour of concrete, the tension member may be threaded through rear nut 24, anchor body 12 and encapsulation 13, cap 21, and front nut 22. Seals 20, 26 may or may not be present. Intermediate anchor assembly 10 may be slid along tension member 27 to a location on tension member 27. Rear nut 24 may then be disengaged from rear encapsulation extension 30 but remain on tension member 27. Rear seal 26 may be applied to tension member 27 between rear nut 24 and anchor body 12 and may be slid along tension member 27 into the annular space between rear encapsulation extension 30 and tension member 27. Head 37, if present, may abut the end of rear encapsulation extension 30. Rear nut 24 may then be re-engaged with rear encapsulation extension 30 such that rear seal 26 is compressed to fill voids between anchor body 12 and rear nut 24.

Anchor assembly, including tension member 27 extending therethrough, may then be positioned such that a portion of a concrete form fits into the space defined by cap 21 and front nut 22. Front nut 22 is tightened such that intermediate anchor assembly 10 is retained in position. Additional fasteners, such as nails, may be used to further retain anchor assembly with respect to the concrete form and to keep it from rotating.

Once concrete has been poured, thereby embedding the encapsulated anchor body and attached rear nut 24, the concrete form may be removed. Front nut 22 and cap 21 may be disengaged from cap extension 38 and encapsulation 13, respectively, and slid along tension member 27 so as to allow wedges 18 to be inserted into anchor body bore 11. Once wedges 18 are seated on the frustoconical inner surface, tension member 27 may be tensioned.

Once tension member 27 has been tensioned, cap 21 may be re-engaged with front encapsulation extension 32. Front seal 20 may be applied to tension member 27 between front nut 22 and cap 21 and may be slid along tension member 27 and into the annular space between cap extension 38 and tension member 27. Head 28, if present, may abut the end of cap 21. In some embodiments, front seal 20 may be placed in cap 21.

Front nut 22 may then be re-engaged with cap extension 38 such that front seal 20 is compressed to fill voids between anchor body 12, cap 21, and front nut 22.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the scope of the present disclosure.

In the claims that follow, unless explicitly so recited, the sequential recitation of steps is not intended to require that the steps be recited sequentially or in the order recited. The steps may be performed in any order and two or more steps may be performed simultaneously.

What is claimed is:

1. An intermediate anchor assembly for use on a tension member in a post-tensioning concrete application, the intermediate anchor assembly comprising:

an anchor body having an anchor body bore therethrough;

an encapsulation, the encapsulation defining a front encapsulation extension and a rear encapsulation extension, each of the front encapsulation extension and the rear encapsulation extension having a bore aligned with the anchor body bore;

a rear nut concentrically engaging the rear encapsulation extension;

a cap releasably engaging the front encapsulation extension, the cap having a bore therethrough, and a cap extension;

a front nut engaging the cap extension;

a rear seal positioned in the rear annular space; and a front seal positioned in the front annular space.

2. The intermediate anchor assembly of claim 1 wherein the rear seal and the front seal are each a split seal.

3. The intermediate anchor assembly of claim 1 wherein at least one of the front nut and the rear nut is a self-tapping nut.

4. The intermediate anchor assembly of claim 1 wherein the cap includes an annular groove, and wherein a cap seal is disposed in the annular groove.

5. The intermediate anchor assembly of claim 1 wherein at least one of the rear seal and the front seal includes a head and a tubular body extending therefrom.

6. The intermediate anchor assembly of claim 1 wherein each of the rear seal and the front seal includes a longitudinal split.

7. A method for anchoring and sealing a tension member in a post-tensioning concrete application, comprising the steps of:

a) providing an intermediate anchor assembly comprising:

an anchor body having an anchor body bore therethrough, a frustoconical inner chamber, an encapsulation, the encapsulation defining a front encapsulation extension and a rear encapsulation extension, each of the front encapsulation extension and the rear encapsulation extension having a bore aligned with the anchor body bore;

a rear nut engaged with the rear encapsulation extension, wherein placement of a tension member in the anchor assembly results in the rear nut, the rear encapsulation extension, and the anchor body defining a rear annular space therewith;

a cap engaged with the front encapsulation extension, the cap having a bore therethrough, and a cap extension; and a front nut engaged with the cap extension, wherein placement of a tension member in the anchor assembly results in the front nut, the cap extension, and the anchor body defining a front annular space therewith;

b) positioning the tension member in the anchor body bore;

c) decoupling the cap from the front encapsulation extension;

d) positioning at least one wedge in the frustoconical inner chamber;

e) tensioning tension member;

f) recoupling the cap to the front encapsulation extension;

g) decoupling the rear nut from the rear encapsulation extension;

h) positioning a deformable rear seal in the rear annular space;

i) recoupling the rear nut to the rear encapsulation extension;

j) decoupling the front nut from the cap extension;

k) positioning a front seal in the front annular space; and l) recoupling the front nut to the cap extension.

8. The method of claim 7 wherein completion of steps f) through l) sealingly encloses a portion of the tension member between the rear seal and the front seal.

9. The method of claim 8 wherein engagement of the rear nut with the rear encapsulation extension deforms the rear seal.

10. The method of claim 8 wherein engagement of the front nut with the cap extension deforms the front seal.

11. The method of claim 8 wherein the rear seal and the front seal are each a split seal.

12. The method of claim 11 wherein each of the rear seal and the front seal includes a longitudinal split.

13. The method of claim 11 wherein at least one of the rear seal and the front seal includes a head and a tubular body extending therefrom.

14. The method of claim 8 wherein at least one of the front nut and the rear nut is a self-tapping nut.

15. The method of claim 8 wherein the cap includes an annular groove, and wherein a cap seal is disposed in the annular groove.

16. The method of claim 15 wherein engagement of the cap with the front encapsulation deforms the cap seal.

* * * * *